US006110007A

United States Patent [19]

Rittmann

[11] Patent Number: 6,110,007

[45] Date of Patent: Aug. 29, 2000

[54] T-BACK BREAST SUPPORT SYSTEM GARMENT

[76] Inventor: Jean V. Rittmann, 4700-176th St. SW. #A303, Lynnwood, Wash. 98037-3451

[21] Appl. No.: 09/244,540

[22] Filed: Feb. 3, 1999

[51] Int. Cl.[7] ..... A41C 3/00

[52] U.S. Cl. ..... 450/86; 450/80; 450/155; 450/1

[58] Field of Search ..... 450/86, 1, 21, 450/22, 23, 24, 80, 83, 20, 35, 71, 77, 79, 17, 155; 2/44, 45, 73, 92, 109, 110; 602/19

[56] References Cited

U.S. PATENT DOCUMENTS

| | | | |
|---|---|---|---|
| 1,708,713 | 4/1929 | Zweben . | |
| 2,926,669 | 3/1960 | Strauss . | |
| 3,071,140 | 1/1963 | Adler . | |
| 4,276,884 | 7/1981 | O'Daniels . | |
| 4,289,137 | 9/1981 | Dell . | |
| 4,411,269 | 10/1983 | Weintraub . | |
| 4,444,191 | 4/1984 | Harned . | |
| 4,836,824 | 6/1989 | Seering . | |
| 5,024,628 | 6/1991 | Sanchez | 450/86 |
| 5,094,648 | 3/1992 | Turner . | |
| 5,662,512 | 9/1997 | Cohen . | |
| 5,702,286 | 12/1997 | Seering . | |
| 5,823,851 | 10/1998 | Dicker | 450/86 |
| 5,964,642 | 10/1999 | Fildan | 450/86 |

*Primary Examiner*—Gloria M. Hale

[57] ABSTRACT

The front weight support system/garment/bra supports front weight substantially on a wearer's upper back, above the shoulder blades and below the cervical vertebrae of the neck. Weight is supported underneath by the front enclosure 3*a* which is extended to the wearer's shoulder-tops by opposite side front straps 3*a* and 11*a* , which secure to opposite side edges of the yoke 2*a*. The yoke restrains the front weight rearwardly and upwardly against the wearer's upper back. The downward end of the yoke is leveraged down by spine strap 7*a*, vertically adjustably secured to the rear of circumferential body band 9*a* by single adjuster 10*a*. The enclosure is secured to the front of the body band to keep the enclosure from moving forward off the weight. The yoke is positioned off the back of the wearer's neck by its shape, rigidity, and/or with an attached spine strap. Laterally rigid rod 88*a* in yoke can hold the front straps laterally apart and off the sides of the wearer's neck. Using a rear band closure (5*a* and 55*a* ) and a bottom-side spine strap split, (4*a* and 44*a*) the body band's circumference can be varied; and, when open, can extend to easily slip over the extra width of the shoulders, while still keeping both sides of the closure proximal for easy closing. This arrangement needs only one spine strap length adjuster. Front weight can be breasts, a child, a wearer's belly, or merchandise.

19 Claims, 5 Drawing Sheets

Figure 2:
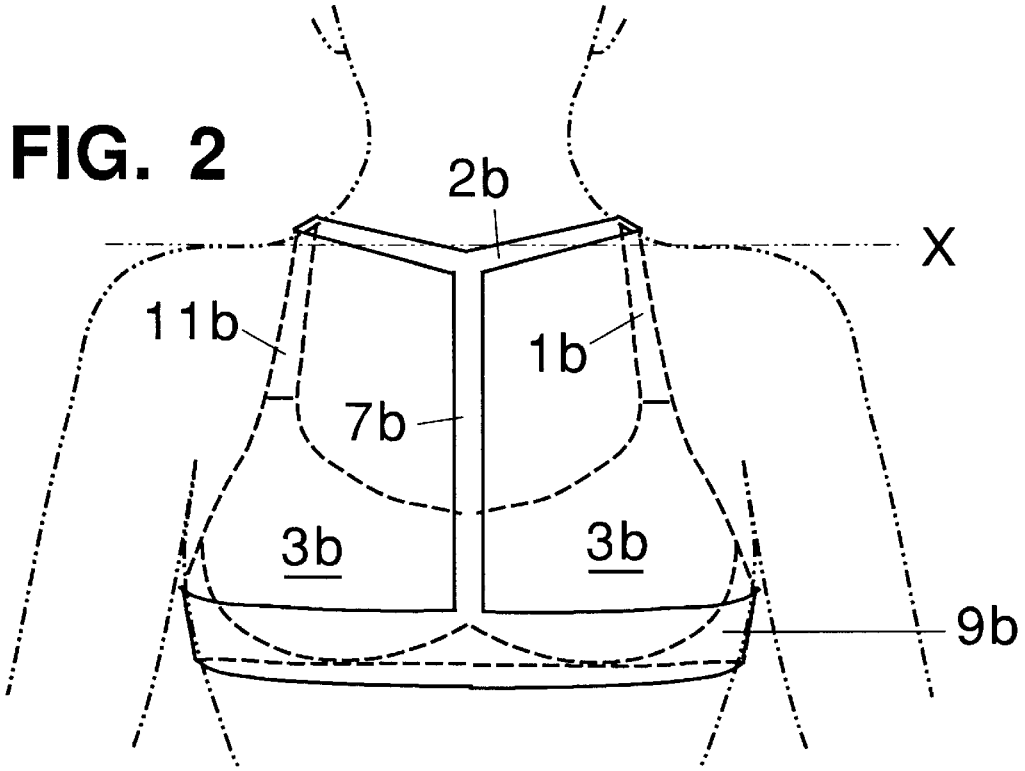

FIG. 1A
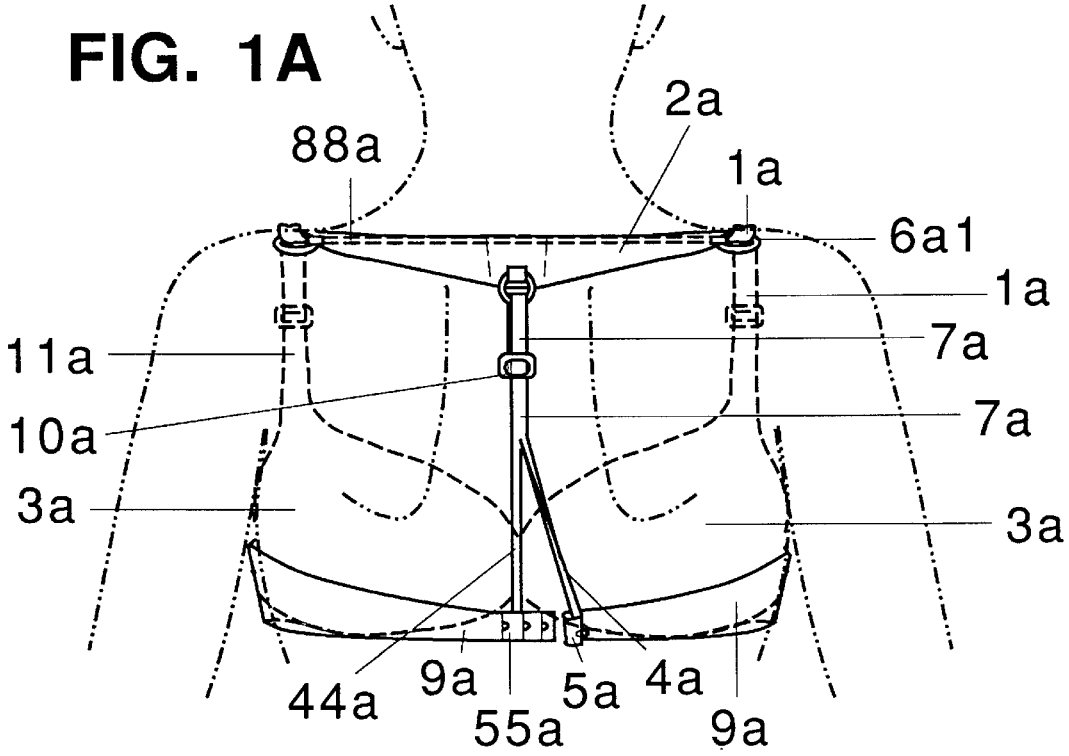
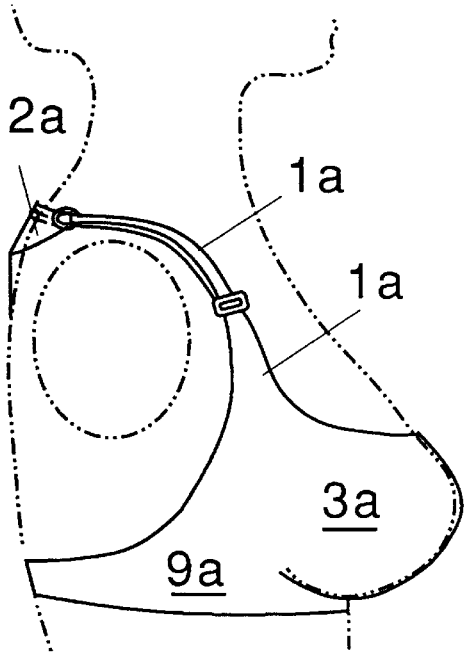
FIG. 1B
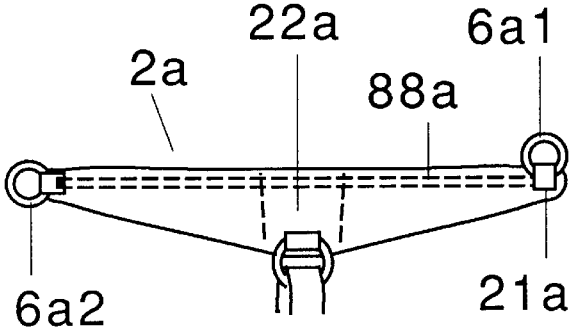
FIG. 1C

T-BACK BREAST SUPPORT SYSTEM GARMENT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF INVENTION

This invention relates to breast or chest supports, E.G., brassieres. More specifically: to bras with shoulder strap arrangements and connecting features; to bras with stiffening strips or stays; and to front weight support garments.

Many women routinely have bra discomfort. The body band of prior-art strap bras tightly squeezes the chest, rides up or turns under the breasts, rides up behind the armpit, and the band's elasticity wears out quickly.

Straps dig into and/or slip off the shoulders. Underwires dig into ribs under the breasts. Prior-art cross-back bras rub the shoulder blades. Prior-art longline bras bind and bunch up. Prior-art halter bras pull at the fragile neck, sit above most necklines in the back and on the sides, and the body band slips downward in back. Back-closing halters are difficult for the wearer to stretch back and close correctly.

U.S. Pat. No. 4,444,191 by Marguerite J. Harned, granted Apr. 24, 1981 entitled COMFORT GARMENT, FIG. 6, shows a halter bra with a tall/wide, neckline. Front weight pulls only at the top of the neckline; and with the neck's slope pushing it up and nothing to hold it down, the bottom of the bras halter neckline bunches upwards. Full torso bras, like those shown in Harned's other figures, can restrict chest expansion, bunch upwards, and can require an additional stomach fit. Tall body bands (longline bras) are tall to help hold the bra down. This might help wearers whose diaphragm is larger than their waist, but may not benefit large waisted wearers.

U.S. Pat. No. 4,289,137 by Dorothy G. Dell and Christine H. Clifford, granted Aug. 15, 1979, entitled SPORTS BRASSIERE, is a front closing Y-shaped back (racer-back) size-invariable stretch bra, that mostly 'squeezes every-thing in'. The trade-off is: the wider the stem of the Y, the more it rubs shoulder blades, especially when the wearer's running-elbows move backwards; vs. the narrower the Y stem, the shoulder straps are to the sides of the neck, where they are visible above many outerwear necklines. The front closure can feel bulky and can not vary the body band circumference like rear closures (front variance would draw the breasts apart or together). The wide Y (Ɣ) averts back height and width variance. Non-adjustable stretch bras squeeze the chest all over. Hook-type front closures can accidentally unhook (from forward arm movement).

U.S. Pat. No. 3,071,140 by Sanford Adler, granted Jan. 1, 1963, entitled BRASSIERE is a cross-back bra that tightly confines shoulder blades and is size invariable. With the back cross nearly as low as the front breasts, the bra basically pulls breast weight backwards. The straps' low cross can greatly rub the shoulder blades because it takes nearly twice the force/tension to support weight using such angular (≈45° from horizontal) straps. U.S. Pat. No. 1,708,713 by Samuel Zweben, granted Apr. 9, 1929, entitled APPAREL GARMENT has back angled straps that can cause: the rear of the body band to ride up, shoulder straps to ride up on the neck, and the rear straps to rub shoulder blades. It can also be difficult to close in back.

Heretofore the following have been used: Stretch cloth, vertical stays in the band and bra cups, crossed straps, halters, low back support, longline bras, exposed elastic (for friction), waist bands, extra straps, and more.

BRIEF SUMMARY OF THE INVENTION

The front weight support system/garment/bra supports front weight substantially on a wearer's upper back, above the shoulder blades and below the cervical vertebrae of the neck. Weight is supported underneath by a front enclosure which is extended to the wearer's shoulder-tops by opposite side front straps, which secure to opposite side edges of a yoke. The yoke restrains the front weight rearwardly and upwardly against the wearer's upper back. The downward end of the yoke is leveraged down by a spine strap secured to the rear of a circumferential body band. The enclosure is secured to the front of the body band to keep the enclosure from moving forward off the weight.

The yoke is positioned off the back of the wearer's neck by its shape, rigidity, and/or with an attached spine strap. A laterally rigid yoke can hold the front straps laterally apart and off the sides of the wearer's neck. Using a rear band closure and a bottom-side spine strap split, the body band's circumference can be varied. When open, it can extend to easily slip over the width of the shoulders, while keeping both sides of the closure proximal for easy closing. Only one spine strap length adjuster is needed. Front weight can be breasts, a young child, a pregnant wearer's belly, or merchandise.

ADVANTAGES OF THE INVENTION

The system/method/bra supports front weight on the sturdy upper back. Unlike prior-art bras: The front straps of the bra will not fall off the shoulders nor 'dig a pit' in the shoulder to stay positioned. The bra allows great freedom of shoulder movement, provides back support, and nicely lifts and shapes breasts. Unlike prior-art strap bras: the bra's body band and straps need not be uncomfortably tight and the bra's elasticity therefore lasts longer. The bra's body band will not ride up, or turn under the breasts or in the rear behind the armpit. Underwires will not dig at the ribs, and are not necessary, even for large (DDD) breasts. The bra can look pleasing, needs only thin straps and a thin body band, a short closure, and is about as easy to put on, remove, and adjust as prior-art strap bras. The bra can also support a pregnant woman's belly: greatly relieving lower back stress.

BRIEF DESCRIPTION OF THE DRAWINGS (all bra embodiments are shown on upright phantom wearers)

Figure 3:
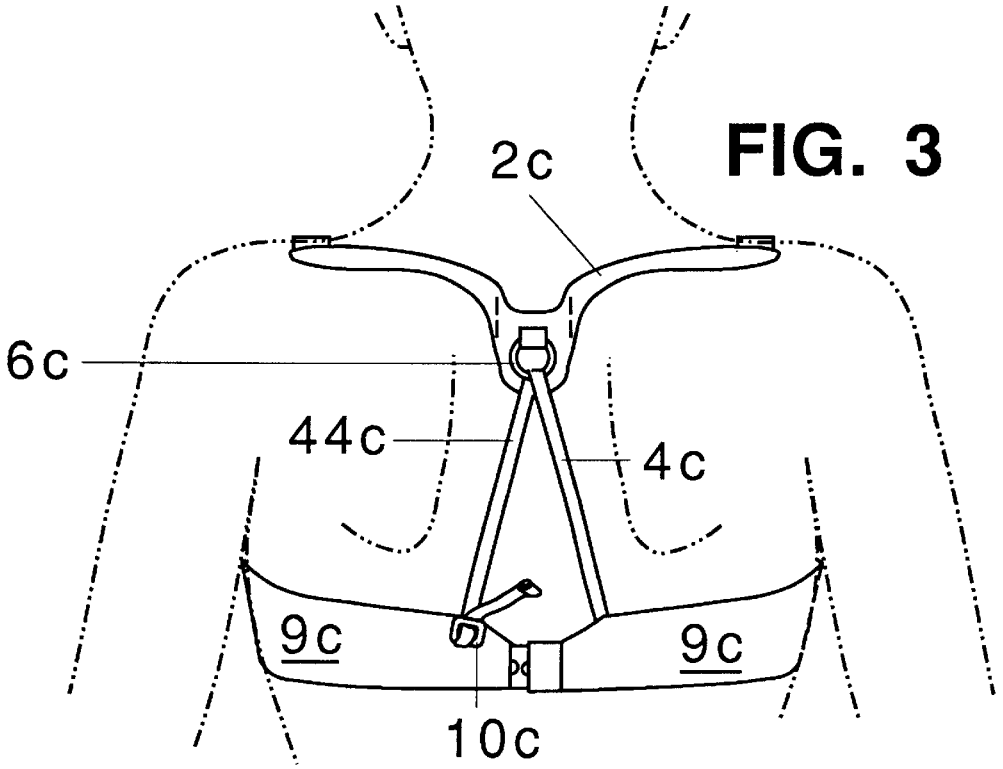
Figure 4:
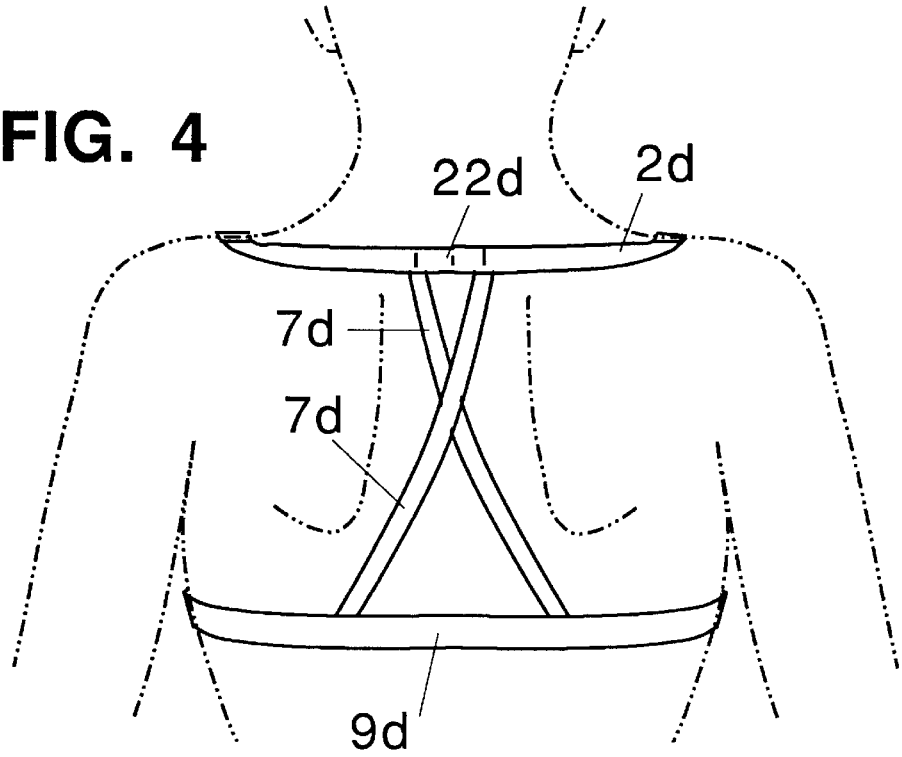
Figure 5:
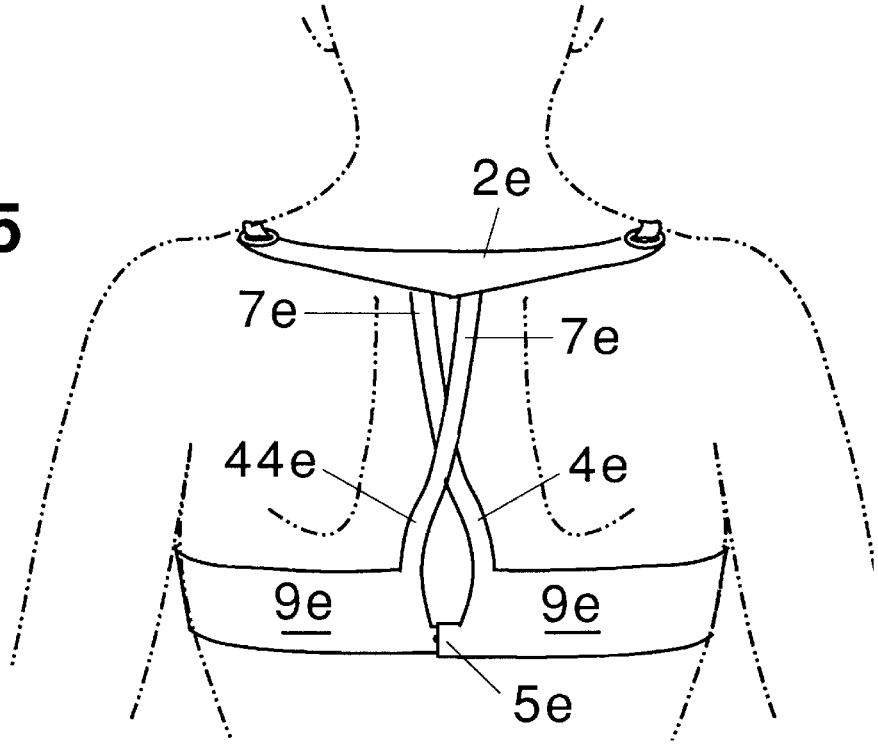
Figure 6A:
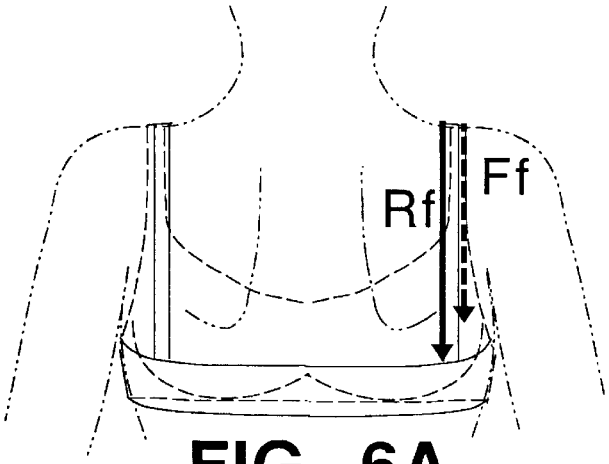
Figure 7A:
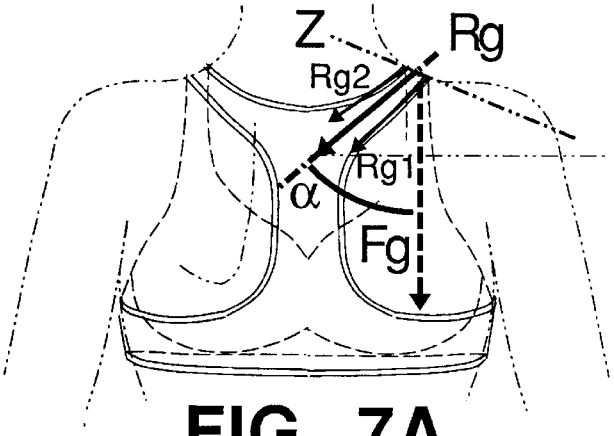
Figure 8A:
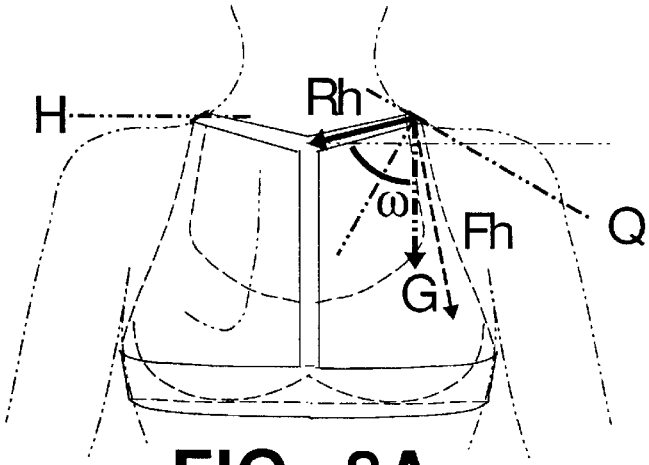
Figure 9A:
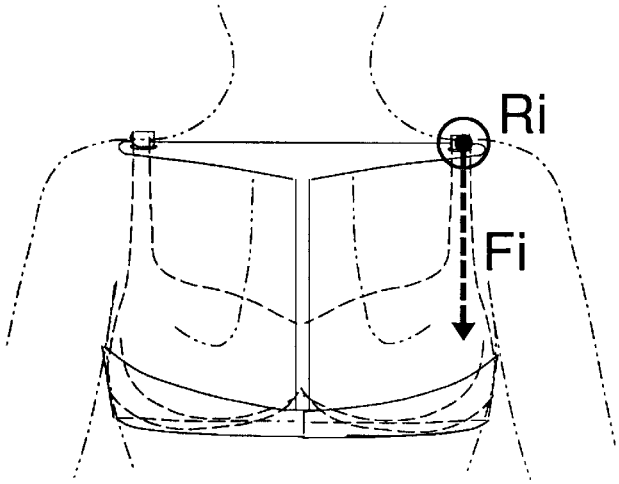
Figure 11:
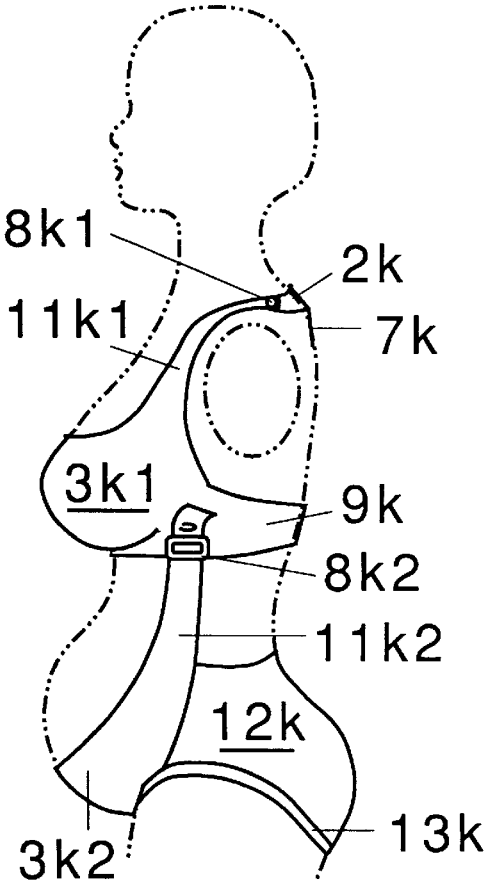
Figure 10:
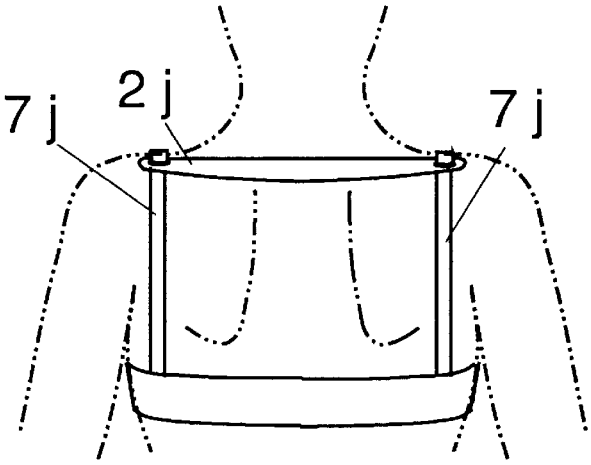

FIG. 1A is an embodiment of the bra; with a rigid rod in yoke, a spine strap split, and an unclasped rear closure; rear view FIG. 1B is the embodiment of FIG. 1A, right side view FIG. 1C is the yoke of FIG. 1A; enlarged back view FIG. 2 is a narrow neckline embodiment of the bra; rear view FIG. 3 is an embodiment of the bra, with a tall spine strap split; rear view FIG. 4 is an embodiment of the bra, with a crossed spine strap; rear view FIG. 5 is an embodiment of the bra, with a tall band; rear view FIG. 6A; 6B show tensions on a prior-art strap bra: rear; right side view FIG. 7A; 7B show tensions on a prior-art Y-back bra: rear; right side view FIG. 8A; 8B show tensions on the bra from FIG. 1A: rear; right side view FIG. 9A; 9B show tensions on the bra from FIG. 2: rear; right side view FIG. 10 is an embodiment of the bra, with two spine strap 'sides'; rear view FIG. 11 is an embodiment of the bra, with a belly support, left side view

DESCRIPTION OF THE NOTATIONS

1 a right side front strap
11 a left side front strap
2 a yoke
3 a front weight enclosure
4 the right side of a split
44 the left side of a split
5 a right side part of a band closure
55 a left side part of a band closure
6 a jump ring
7 a spine strap
8 a front strap adjuster
88 a rigid rod
9 a body embracing band
10 a spine strap adjuster
12 panties
13 a left side leg band
21 a yoke adjuster
22 a yoke convexity
F a front-side tension
R a rear-side tension
sub-notations a thru k identify portions in FIGS. 1 to 11 respectively.

DESCRIPTION OF THE INVENTION

1. Prior-art Bras—The Big Squeeze

Prior-art bras support a wearer's breasts mostly by friction caused the body band being squeezed against the wearer's chest (diaphragm). Friction on a mobile wearer is a temporary means of support, and can be quite uncomfortable. Strapless bras support breast weight basically by band friction to the body. Prior-art strap bras add shoulder straps to help lift the breast weight, but the straps are also only supported by the body band (in the rear). That is, the body band almost does the whole job. The band is held up by friction to the body, and held down by the protuberance of the breasts above it in front. The band must be uncomfortably tight for sufficient friction. This tightness can turn the band up under the breasts and stretch/wear out the elastic quickly. Because breast weight is mostly squeezed rearwardly by the body band, underwires are often used to shape the breasts upward. With underwires, breast weight rests mostly at the semi-circular wire's bottom most point, which then rests on, and digs into, the ribs. Human shoulders tend to slant down laterally, so shoulder straps tend to fall off. Shoulder straps are often tightened extensively to create a skin crater in the shoulder, which helps keep the straps from falling off; but this can be uncomfortable, and can create drooping shoulders. This also promotes the bra to pull up; cutting up into the breasts and upper back behind the armpit. Lifting the arms accentuates this.

U.S. Pat. No. 1,708,713 has shoulder straps attached together at the body band's central rear. Because the straps angle in back, more tension is required to hold the straps down in back. Such tension rubs shoulder blades. Such strap tension greatly pulls up the rear of the band (since only friction and the front breast protuberancing keep the body band down). The back angling also pulls the bra's front top sides inwards.

Halter bras have disadvantages: The neck portion can visibly extend above all but high neckline outerwear. The halter supports front weight by pulling forwards high on the neck. Backwards support is only the cervical (neck) vertebra with little rearward muscle. (Most neck muscles position laterally). The front weight pulls only at the top-most part of the neck strap, even with tall/wide neck-straps, because there is no force to secure a tall/wider band below that point. Halters ride up high on the neck because of the slope of the lateral neck muscles, and the sideways pull of the straps in the front. In all, haltering on the neck can be physically unwise. Also, a halter's unsupported rear body band can bunch down. Hooking a halter's band in the rear requires agility, as the long ends of the band can easily twist or misalign for an incorrect closure.

2. Where The Bra Supports

The function of each portion of the system/garment/bra is to provide maximum breast, or front support, while minimizing discomfort, slippage, and restriction of body movement. Building a bra is like building a bridge: It's not how much material you use, but where you place the support.

Up until now, no bras have been designed to support front weight on the upper back, below the cervical vertebra, and above the mobile shoulder blades. However fragile the neck is, T1, the first thoracic vertebra below the neck, is extremely sturdy. It is secured by the first rib, which is secured to the sternum (front chest-bone) below the clavicle in front. Laterally from T1 is a very sturdy place to position weight. Vertebra T1 is laterally in line with the tops of a wearer's shoulders above the skin (as notated with X in FIG. 2). Supporting at this line allows shoulder blade freedom of movement.

In less developed countries, a pair of pails are still often carried balanced by individuals on a wooden frame, or yoke, that is placed on the upper back areas of the individual. By adding a spine strap, the yoke can be uniquely flatter than the wooden yoke, improving looks and comfort. The bra's yoke, especially when rigid, functions like the wooden yoke in two ways: It balances front weight (like one breast against the other) where the yoke is the lever and the balance point is T1 of the spine; and it pulls weight rearwardly and upwardly onto the wearer's upper back. The stability of the balancing support is improved by the front enclosure securing the opposite-side weights (like breasts) together in a front enclosure. Balancing does not require fiction. With front weight substantially pulled up on and balanced onto a wearer's upper back, not pulled back by the body band and the band's friction to the wearer's chest, underwires don't rest on or dig into ribs, and wide bands and tall band closures are not needed.

3. The T-Back's Unique Centered Closure Method

In the past, Y-shaped, or racer-back bras have not been known to be closable in the rear, with a single closure, where the stem of the Y would remain centered, band circumference, (by way of the closure) remain variable, and only one rear vertical adjustment means needed. A bra with no closure, like a stretch bra, must stretch over the shoulders, which are about 8" more than the chest's circumference under the breasts. The stretched band must also clear the circumference of the breasts, which vary from wearer to wearer.

When the rear closure is opened, the spine strap of the present invention splits and each bottom half is attached to a corresponding side of the closure. This extends the band's circumference. For example, if the 'split' is 4" tall, then the band's circumference extends an additional 8". The top of the spine strap or split attaches to the yoke positioned behind the wearer so both ends of the closure stay proximal, for an easy twist-free band closure. The split allows the band's width to be varied by the closure, while keeping the spine strap perfectly centered in back. The spine strap only needs one adjuster (unlike the tensioning straps of U.S. Pat. No. 4,276,884 by Avis O'Daniels, granted Jul. 7, 1981, entitled BRASSIERE). Little band strength is needed: so one or two hooks are all even a 44DDD bra needs. Fewer hooks ease hooking in back, and the band is less likely to twist since it does not need to be tight.

4. Description of One Embodiment of the Invention

One embodiment of the front weight support system/garment/bra, for an upright wearer, is shown in FIG. 1A and 1B: rear and right side views respectively. The transversely circumferential body band 9*a* has a forwardly located front enclosure 3*a*. The enclosure is of a size and shape to receive front weight of the wearer. The enclosure has laterally opposite sides wherein each side is secured to the downward end of a corresponding front strap of the pair of vertically elongated front straps 1*a* and 11*a*. Laterally elongated yoke 2*a* has laterally opposite side edges wherein each edge is secured to the upward end of a corresponding front strap. The yoke is of a size, shape, and construction to be received only onto the wearer's upper back. Vertically elongated spine strap 7*a* has an upward end secured to the downward central portion of the yoke. The spine strap's downward end is secured to the rearward portion of the body band. When worn, the bra supports front weight substantially on the wearer's upper back.

The front straps upwardly extend the enclosure to opposite side lateral ends of the yoke. The band secures the bra transversely around the wearer's chest, keeps the weight enclosure from moving forward, and downwardly secures the spine strap. The yoke supports a substantial portion of frontal weight on the wearer's upper back. The spine strap keeps the downward end of the yoke from flipping upward. The spine strap also secures the rear of the body band from riding downward.

Body band 9*a* has rearwardly located opposite side edges. The band edges have a reuseable means to attach and separate the edges. This means is a closure. The closure has opposite side parts 5*a* and 55*a*. The spine strap 7*a* has a vertically elongated split. The split (right and left side 4*a* and 44*a* respectively) has opposite side downward ends. The split's ends secure to a corresponding band edge. When the band closure is open, the downward ends of the spine strap's vertical split separate so the bra can easily slip over the wearer's neck and thru the arms, thereby clearing the shoulder's circumference. The split's length is short to draw both ends of the closure proximal, for easy closing. Spine strap 7*a* is vertically adjusted loose, by adjuster 10*a* (thru a jump ring: not notated), so the yoke's bottom nearly lifts. The yoke 2*a* is substantially laterally rigid, to laterally separate the front straps near the neck for a wide neckline, to push the weight off the sides of the wearer's neck, and to prevent straps from pulling sideways. The yoke shown is a sagittally flexible 1/16" thick polypropylene with a 3/32" diameter rigid metal rod (like coat hanger wire) 88*a* (horizontal dotted lines) for extra lateral support, like for heavy breasts. The yoke's lateral ends are vertically short for comfort when lifting arms above the head. Front strap 1*a* loops thru jump ring 6*a*1 secured to the yoke.

FIG. 1C is the enlarged yoke of FIG. 1A. The yoke can be laterally extended by a yoke adjuster like right-side adjuster 21*a*. Adjuster 21*a* is a sturdy square snap, which secures front strap jump ring 6*a*1, in a vertical position, to yoke 2*a*. A similar left-side snap (not notated) shows jump ring 6*a*2 snapped in the laterally extended position. The snaps are secured to rigid rod 88*a*. Alternatively, three triangularly placed snaps may be used instead of one square snap. Other alternative means to laterally adjust a yoke may be used. Suitable yoke lateral length examples: 7 to 8" for a 34" chest wearer; 9 to 10" for a 44" chest wearer. The yoke adjustment may be to accommodate a wearer's shoulder or neckline width. The center of the yoke may have a rearward spinal convexity (22*a*), to avert direct pressure/contact to the spine (vertical dotted lines).

When worn by a wearer, each embodiment of the bra positions the yoke atop the wearer's upper back; and is of a construction, shape, and size to lift front weight substantially on the wearer's upper back. The bra is a method of supporting front weight on an upright wearer. The weight is haltered rearward against the wearer's upper back with a yoke, and distributes that weight downward on the upper back. It does this by having the yoke secured to a transversely circumferential body band by way of a spine strap. The band is downwardly secured by friction to the wearer and the protuberance of the wearer's front weight. The laterally rigid yoke pushes front weight laterally off the sides of the wearer's neck.

5. Description of Other Embodiments of the Invention

Another embodiment of the bra is shown in FIG. 2; rear view. Yoke 2*b* is vertically short (like ¾") and may be laterally stiff (like no-roll elastic), so it remains substantially lateral (not V shaped or curved). The stiffness is so the yoke will only lay flat on a wearer's upper back when spine strap 7*b* is properly adjusted. When the yoke is just stiff, spine strap 7*b* pulls the yoke down off the wearer's neck. That is, some front weight is supported by the body band via the spine strap. The bra may have a closure and/or strap adjustment means (none shown). This minimal design is still more comfortable, and shapes breasts upward better, than prior-art strap and Y-back bras. Yoke 2*b* may alternatively be semi-rigid (like a prior-art stay), or rigid.

Another embodiment of the bra shown in FIG. 3. has a yoke that is laterally rigid. The downward ends of each of the spine strap's split (4*c* and 44*c*) secures to a corresponding side of the rearward portion of band 9*c*. In this figure, 4*c* and 44*c* are one continuous strap, and variable thru jump ring 6*c*. The split extends the entire heights of the spine strap. The split draws both sides of the closure behind the arms, so they are proximal for easy closing (just less so than a short split). 4*c* lays over 44*c* at the top where they 'split'. Alternatively, split and/or closure lay-over can be reversed. The spread ends of the spine strap split lift the top portion of a tall band. Because the rearward portion of the body band is virtually at the closure, rear portions of the body band can be considered as part of a rear closure, and vice versa, for this text and claims. Spine strap adjuster 10*c* is an adjustment buckle, where the strap is fed back thru upwardly, with folded over elastic at the end to keep it from pulling out of the adjuster. The one adjuster adjusts the length of both 4*c* and 44*c* together. Yoke 2*c* is substantially laterally rigid, and extends lower into the inverted triangular region of the upper back for a different look. The body band does not need the strength of a tall closure.

FIG. 4 shows laterally rigid yoke 2*d* with spinal convexity 22*d*. Spine strap 7*d* (two slightly crossed lengths of elastic) function as a single spine strap. Only a thin body band (9*d*)

is needed to keep the front enclosure from slipping forward off the breasts, and to keep the yoke down.

FIG. 5 shows two-part spine strap 7*e* crossing into its spine strap split 4*e* and 44*e*. The split bows apart due to slight band tension. Body band 9*e* is tall in back, and has a one hook closure (right side is 5*e*). A tall band is not needed for large breasts that tend to spill out the sides with prior-art strap bras. The top of semi-rigid yoke 2*e* (1/16" sheet nylon) curves slightly, so it should position rearwardly below the shoulder tops; so its lateral ends do not angle/cut into a wearer's shoulders that excessively slope (as shown).

Human belly weight forwardly pulls the rearwardly unsupported lumbar vertebrae. The 'belly bra' embodiment, shown in FIG. 11, transfers belly support to a wearer's upper back. The wearer's belly is lifted by front enclosure 3*k*2, attached to body band 9*k* by front strap 11*k*2; adjusted thru adjustment buckle 8*k*2 with Velcro®, hook or loop fasteners, added for a secure hold. By positioning 8*k*2 nearly under the wearer's arm, top front straps, like 11*k*1, pull back towards the front of the wearer's arms. The forward portion of the body band, which is partially front enclosure 3*k*1, positions top front straps forward enough so they do not rub/tension against the front of the wearer's arms. A pair of leg bands, like left leg band 13*k*, are for keeping enclosure 3*k*2 from moving forward off the belly. The belly's enclosure and leg bands are usefully secured to a pair of open-front panties 12*k*, which may be put on separately from the body band portion, then attached to the band by way of adjustment means like 8*k*2. Front (breast) enclosure 3*k*1 is shown, but, is not needed to support belly weight. Together, 11*k*1 and 11*k*2 act as one front strap. Sagittally-flat rigid yoke 2k can appear to 'lift up' where it is held down by spine strap 7*k*. Yoke rigidity in any embodiment may soften downwardly to conform with the shape of a wearer's back.

FIG. 10, shows two spine strap 'sides' (7*j*) acting as a single spine strap; adjustably looped thru rigid yoke 2*j*. Both sides of 7*j* lay over mobile shoulder blades. Straps 7*j* are separately adjusted loose, where the bottom of the yoke nearly lifts, so front weight supports on the upper back.

6. Vector Tension Analogies For Some Bras

FIGS. 6 to 9 show tension vectors from any front weight lifted onto a wearer's shoulder. FIGS. 6B, 7B, 8B, and 9B show strap tensions where the shoulder is treated like a frictionless pulley. Front tension angles are inexact.

Figure 6B:
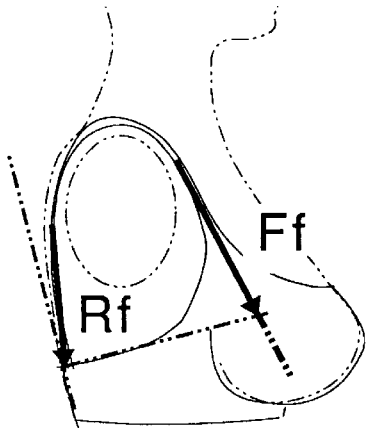

FIG. 6A shows front-side tension Ff; and rear-side tension Rf (pulled straight down by the body band). FIG. 6B, a right side view, shows Ff; and shows Rf ending about where the strap attaches to the band. The slope of the wearer's back at that point is vertical, or slightly negative. The phantom line that follows the slope of the back is the tangent to the body where the rear strap supports at the body band. The angle of the line perpendicular to that line shows the substantially horizontal angle of pull required for support. In other words, prior-art strap bras support substantially by the body band pulling front weight rearwardly.

Though SPORTS BRASSIERE, by Dell and Clifford looks similar to the FIG. 1 embodiment, it supports substantially horizontally, not vertically like mine. That is, Dell's bra supports mostly by the body band pulling front weight rearwardly. FIG. 7A shows strap tensions off the shoulder of Dell's bra. Front-side shoulder strap tension Fg is vertical. Rearward reaction tension Rg2 is about equal to tension Rg1 because there is an equal length of material that pulls angularly. (It is like having two pieces of elastic of equal length and elasticity: it takes the same amount of force to pull them longer the same distance.) Because Rg1≈Rg2, and angle is to gravity: (Rg2∠≈58°) plus (Rg1∠≈47°) equals Rg ∠α≈52°. At 52°, Dell's straps are about equally held down by the band as held back against the wearer's back. And the more curved the top of the yoke (≈Rg2) is, and the lower Rg faces; the more strap support lifts from the back of the body band. So, the yoke's top curving and extra heighth (distance down from Rg2 to Rg1) averts backwards support by the upper back. The yoke's top curve has other drawbacks, specified later.

Dell's straps rest at a point on the shoulder/neck slope whose tangent Z is perpendicular to the summed angles of Fg and Rg.

Figure 7B:
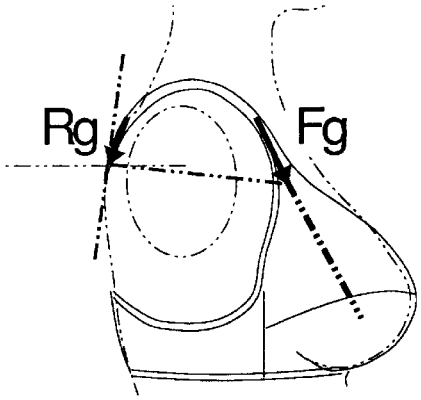

FIG. 7B shows Fg; and shows the tangential point on the body where Rg supports rearwardly. The slope, and slope's tangent of the wearer's spine from which Rg pulls is nearly vertical. The angle of the line perpendicular to the tangent is substantially horizontal. This shows Dell's bra substantially supports by 'pulling back', not 'lifting'. Also Rg1 lays over, not above, the wearer's shoulder blade; therefore Dell's bra does not support only on the wearer's upper back (as defined in part 7. Symmetry, Materials, . . . ).

FIG. 8A shows tensions on the bra from FIG. 1A, if the yoke shown is laterally flexible. The yoke strap tension Rh supports nearly horizontally at ω≈78° from G (gravitational pull of front weight). The top edge of the yoke is substantially laterally straight, not curved like Dell's yoke. A curved yoke would lower the yoke's angle of tension (which would be the tangent of the yoke's lateral curve off the shoulder top). Because the yoke is formed laterally straight, it can consistently be spine-and-front-strap adjusted, or tailored, below vertebra T1 without lowering the angle of tension.

Figure 8B:
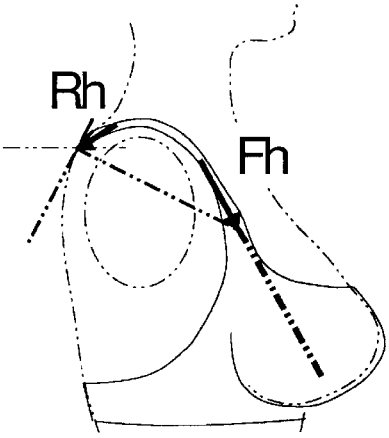

In FIG. 8B. Tension vector Rh supports on the short declining slope of the wearer's upper back (a slope significantly more horizontal than where Dell's strap supports). The phantom line perpendicular to that tangent shows this embodiment of the bra substantially lifts up (Fh to Rh) more than it pulls back.

In FIG. 8A, the sum of the angles between Rh and Fh is perpendicular to the tangential line (Q) at the point of the shoulder's slope where the strap will rest. With the yoke held down by the spine strap, the yoke's Rh faces slightly downwards from horizontal. Because Rh faces down like Fh, and Fh is directed to the right of G, the strap supports at a low point just off the wearer's neck by vertebra T1. Compare this to a prior-art halter (without a spine strap): The halter's neck strap tension vector would position upwards, which in turn would raise the place on the neck where the strap sits (tangent line like Q) up higher on the neck. This is why the spine strap is critical to keeping the neck strap/yoke off a wearer's cervical vertebrae (when the yoke is flexible). Alternatively, with a rigid yoke shaped as shown, the spine strap instead leverages the yoke downward; pivoted at it's lateral ends about lateral/horizontal line H. With a semi-rigid yoke, the extent of the rigidity and the amount of frontal weight become determining factors.

Figure 9B:
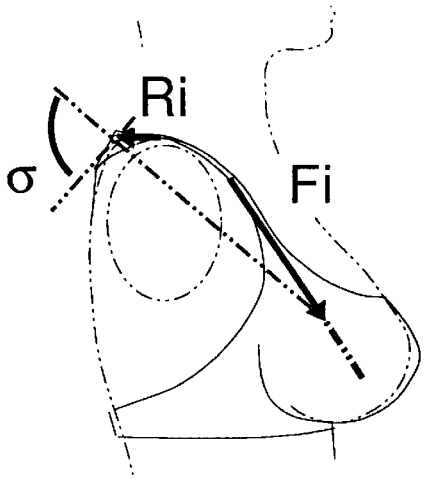

FIG. 9A shows tension on the bra from FIG. 1A. The top edge of the rigid yoke is lateral; and Ri, which faces rearward, is nearly perpendicular to front weight Fi and gravity. FIG. 9B shows tensions Fi and Ri on the bra from FIG. 1B. The wearer's upper back, where the rigid yoke rests, is the most sagittally horizontal slope of a wearer's back. Its tangent is drawn as a declining phantom line. The perpendicular line to this tangent shows front weight is substantially lifted, as compared to being pulled back. The yoke holds front weight back and up. The spine strap leverages down the bottom end of the yoke by angle σ; compensating for the forward component of Fi.

7. Symmetry, Materials, Wearers, and Dimensions

The lateral sides of each of the yokes are vertically short and unusually laterally straight. Yoke curvature (at its lateral ends) detrimentally lowers the angle of back support when the yoke is soft or only stiff, and can dig into the lateral neck or shoulder blades when the yoke is rigid or semi-rigid.

The bra may have front strap length adjusters, like many prior-art bras do. Strap adjusters may position back from the tops of the shoulders: like at the opposite side ends of a rigid yoke (see FIG. 11, notation 8*k*1). Such shoulder-top strap adjusters are less visible from the front. Alternatively, jump rings, for looped-thru front straps, may position rearwardly from the tops of the shoulders (see FIG. 1A, near strap notation 1*a*). As with many prior-art bras, a front weight enclosure may act as part of the forward portion of the body band. When worn, fill of the enclosure (like breasts), and the enclosure's design, determine how extensively the enclosure acts as part of the body band. Therefore, for this invention, the "body band" includes any circumferential support of the front enclosure. The "upper back" includes areas only above and medial to a wearer's shoulder blades. Front straps may be physical continuations of the front enclosure. Front weight may be, but is not limited to being, breasts, a young child, a pregnant woman's belly, stomach weight, or merchandise (some not shown).

The bra may be, but is not limited to being, constructed with the following: Body band, enclosure, and straps: stitched elastic and/or stitched cloth; Rigid yoke: cloth-covered metal or polyimide rod molded in softer plastic; Semi-rigid yoke: polypropylene; Stiff yoke: no-roll elastic; Strap adjustment means: metal or plastic buckles, snaps, or Velcro®; Closures: hook and eye.

The yoke may be used as an addition to prior-art, and future-art, bras, dresses, sportswear, etc. The spine strap 'split,' may be used as an addition to prior-art T-back bras (with less benefit, as wide bands need tall closures).

Measurements in each embodiment are shown in proportion to a wearer, similar to prior-art bras. Band circumference in back may average 5% greater for a wearer than prior-art bras, because band friction force to the wearer is less necessary. All dimensions critical to the bra have been defined by function, calculable formulas, and/or positioning on a wearer. The 'end' of a strap, for this text and claims, is considered the functioning securing point of the strap. In example, FIG. 11 shows excess belly strap extending upward from adjustment means 8*k*2, but the attachment point is at 8*k*2. In FIG. 3 the yoke to spine strap attachment point is jump ring 6*c*. Even wearers with no breast weight benefit from the bra's comfort (some wear bras just to conceal nipples). "Front weight" is then the weight of the front of the bra garment, where the bra's back weighs less than the front.

CONCLUSION

A minimal garment, supporting front weight on a wearer's upper back, and distributed downward with a spine strap secured to a body band is unique to the bra/system/method. The substantially laterally straight and vertically short yoke is unique. The laterally rigid yoke is unique. The single vertically variable spine strap with split is unique.

REFERENCES

*Illustrated Essentials of Musculoskeletal Anatomy* 2nd Ed. by Seig and Adams 1985, p. 3,4, 10, and 11

I claim:

1. A front weight support system for a wearer, comprising:

a transversely circumferential body band; said band having a forwardly located front enclosure;

a pair of vertically elongated front straps;

each said strap having an upward end and a downward end;

said enclosure having laterally opposite sides, each said side secured to said downward end of a corresponding said front strap;

a laterally elongated yoke;

said yoke having laterally opposite side edges, each said yoke edge secured to said upward end of a corresponding said front strap;

a vertically elongated spine strap;

said yoke having a downward portion;

said spine strap having an upward end secured to said downward portion of said yoke;

said body band having a rearward portion;

said spine strap having a downward end secured to said rearward portion of said body band;

wherein, when worn by a wearer: said system supports said front weight substantially on the wearer's upper back.

2. A front weight support system, according to claim 1, wherein: said yoke is substantially laterally straight.

3. A front weight support system, according to claim 2, wherein:

said yoke is substantially laterally stiff and vertically short.

4. A front weight support system, according to claim 1, wherein: when worn, said yoke substantially supports said weight on the wearer's said upper back.

5. A front weight support system, according to claim 1, wherein:

said yoke is substantially laterally semi-rigid.

6. A front weight support system, according to claim 1, wherein:

said yoke is substantially laterally rigid.

7. A front weight support system, according to claim 6, wherein:

said yoke has a pair of lateral adjustment means.

8. A front weight support system, according to claim 7, wherein:

each said yoke's lateral adjustment means is a square snap.

9. A front weight support system, according to claim 1, further including a spine strap vertical length adjuster; and further comprising:

said band having rearwardly located opposite side edges;

said band edges having a reuseable means to attach and separate said band edges;

said spine strap having a vertically elongated split;

said split having opposite side bottom ends; and said split ends secure to a corresponding band edge; wherein:

said reuseable means is a closure.

10. A garment, for supporting front weight substantially on a wearer's upper back, including:

a front weight enclosure, a transversely circumferential body band, a pair of vertically elongated front straps, a laterally elongated yoke, and a vertically elongated spine strap, wherein, when worn by a wearer:

said front straps upwardly extending said enclosure to opposite side lateral ends of said yoke;

said band securing said garment transversely circumferentially around the wearer's chest;

said band downwardly securing said spine strap;

said band rearwardly securing said weight enclosure;

said yoke supporting a substantial portion of said weight on the wearer's said upper back; and said spine strap keeping the downward end of said yoke from flipping upward.

11. A garment, according to claim 10, further including a band closure, a spine strap adjuster, and a spine strap vertical split, wherein:

said band closure is for reuseably circumferentially separating and re-attaching the rearward portion of said band;

when said closure is open, said split is for extending said band's circumference wherein said garment can easily slip over the wearer's shoulders, while still keeping both sides of said closure proximal for easy closing; and said spine strap adjuster which vertically adjusts the length of said spine strap.

12. A garment, according to claim 10, wherein said yoke is substantially laterally rigid.

13. A garment, according to claim 10, wherein said yoke is substantially laterally straight, laterally stiff and vertically short.

14. A garment, according to claim 10, such that said yoke being substantially laterally semi-rigid.

15. A method of supporting front weight on an upright wearer; by way of a garment worn by the wearer, which includes a yoke, an enclosure, and a body band; which comprises the steps of:

placing said yoke onto the wearer's upper back, placing said weight into said enclosure, and securing said band around the wearer's transverse circumference.

16. A method, according to claim 15, said garment further including a spine strap; which further comprises the steps of: vertically adjusting the length of said spine strap.

17. A method, according to claim 15, said garment further including a pair of snaps, which further comprises the steps of: adjusting the lateral width of said yoke by unsnapping, rotating and resnapping said snaps.

18. A method, according to claim 15, which further comprises the steps of: vertically adjusting said spine strap by an adjuster; reuseably circumferentially separating and re-attaching the rearward portion of said band by way of a closure; and when said closure is separated, extending said band's circumference, while still keeping both sides of said closure proximal for easy closing by way of a bottom end split of said spine strap.

19. A method, according to claim 18, said garment further including a spine strap; which further comprises the steps of: vertically adjusting the length of said spine strap.

* * * * *